US005690593A

United States Patent [19]

Huang

[11] Patent Number: 5,690,593

[45] Date of Patent: Nov. 25, 1997

[54] PUSH/PULL EXERCISING APPARATUS

[76] Inventor: Andrew Huang, 6F-1, No. 2, Lane 41, Tein Mou W. Rd., Taipei, Taiwan

[21] Appl. No.: 738,554

[22] Filed: Oct. 28, 1996

[51] Int. Cl.[6] ..... A63B 69/06

[52] U.S. Cl. ..... 482/96; 482/72; 482/95

[58] Field of Search ..... 482/96, 95, 72

[56] References Cited

U.S. PATENT DOCUMENTS

| | | | |
|---|---|---|---|
| 5,520,599 | 5/1996 | Chen | 492/96 |
| 5,527,243 | 6/1996 | Chen | 482/96 |
| 5,556,361 | 9/1996 | Liao | 482/96 |
| 5,569,132 | 10/1996 | Wu | 482/96 |
| 5,573,482 | 11/1996 | Wang et al. | 482/57 |
| 5,582,562 | 12/1996 | Wang et al. | 482/96 |
| 5,584,785 | 12/1996 | Wu | 482/96 |

*Primary Examiner*—Jerome Donnelly
*Attorney, Agent, or Firm*—Bacon & Thomas

[57] ABSTRACT

A push/pull exercising apparatus includes a frame support comprised of a long Tee bar and a short T bar, a mounting support, a handle bar, a pull bar, a seat stay, a support bar, a front pedal mount and a rear pedal mount. The mounting support is pivotally connected to an extreme end of the long Tee bar. The end of the seat stay is pivotally disposed at the long Tee bar in front of a middle section thereof. The pull bar is pivotally disposed between the mounting support and the seat stay. The pedal mounts are respectively disposed at a front end of the seat stay and a bottom end of said mounting support. The handle bar is mounted on the mounting support and is provided with a pair of hand grips capable of being turned in different directions so that the user may push or pull the hand grips to perform push/pull exercises.

5 Claims, 6 Drawing Sheets

PUSH/PULL EXERCISING APPARATUS

BACKGROUND OF THE INVENTION (a) Field of the Invention

The present invention relates generally to a push/pull exercising apparatus, and more particularly to an exercising apparatus with hand grips that may be turned in opposite directions to allow the user to push forwardly or pull rearwardly to achieve exercising effects.

(b) Description of the Prior Art

Various exercising apparatus such as steppers, exer-hikers and exercise bikes are available in the market place. The basic operating principle makes use of the user's weight as a damping force during movement of the user's body so as to achieve the intended exercising effects. Most exercising apparatuses are not usually provided with dual functions.

SUMMARY OF THE INVENTION

Accordingly, a primary object of the present invention is to provide a push/pull exercising apparatus comprising a frame support including a long Tee bar and a short Tee bar, a mounting support, a handle bar, a pull bar, a seat stay, a support bar, a front pedal mount and a rear pedal mount. The components are pivotally assembled so that the pull bar brings the mounting support and the seat stay to displace forwardly or rearwardly so that a seat on the seat stay may elevate therewith to achieve exercising effects.

Another object of the present invention is to provide a push/pull exercising apparatus in which the handle bar inserted in the mounting support may freely change its orientation so that the user seated on the seat may grip the hand grips mounted to the handle bar in a positive or reverse direction to perform forward pushing or rearward pulling actions.

A further object of the present invention is to provide a push/pull exercising apparatus in which the seat stay matches a substantially inverted-U shaped adjustment seat and a locking plate below the seat so that the seat may adjustably displace forwardly and rearwardly and may turn about 180 degrees.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
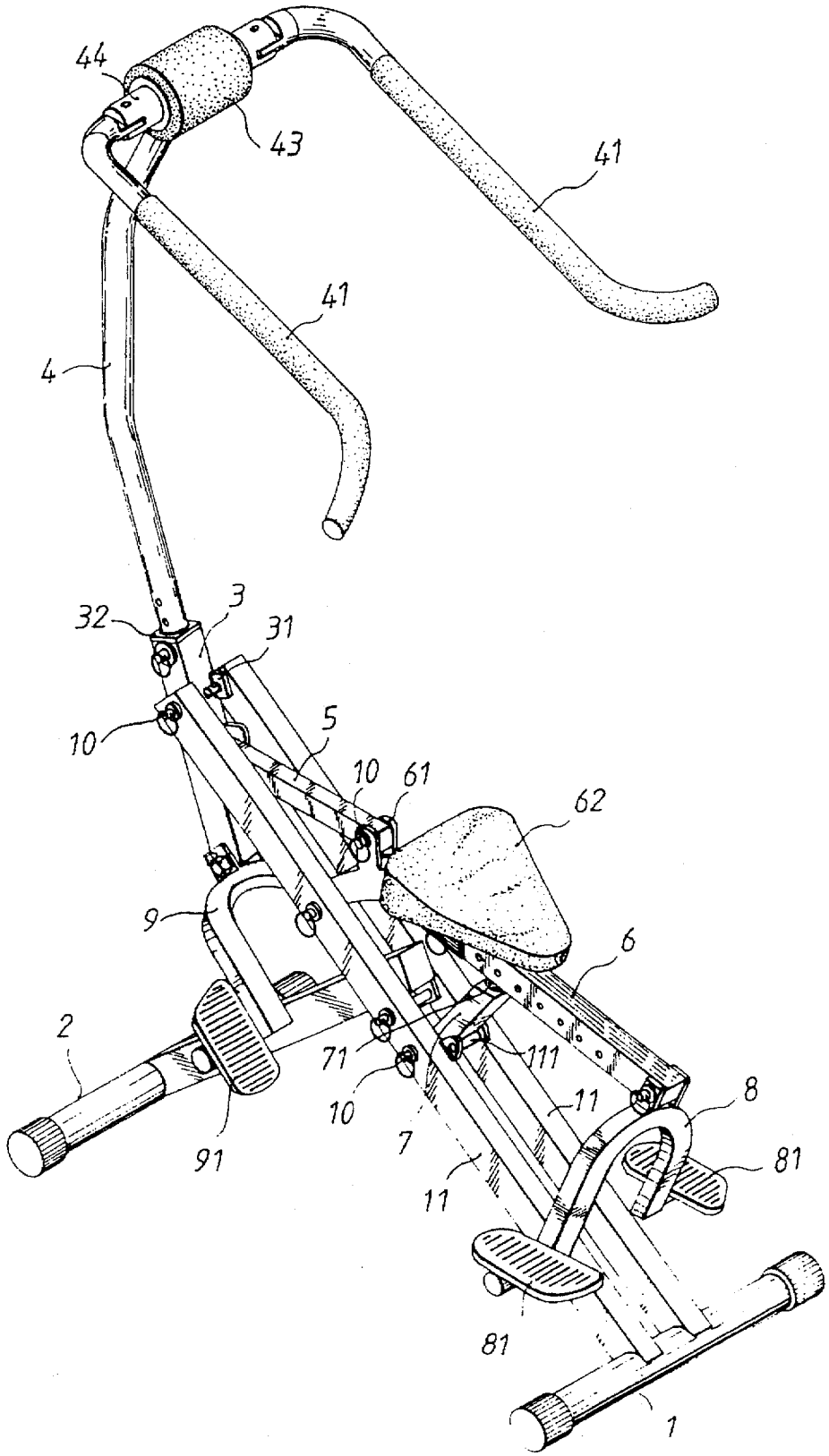
FIG. 1 is an elevational view of the present invention in an assembled state.

With reference to FIG. 1, the exercise apparatus according to the present invention essentially comprises a frame support comprising a long Tee bar 1 and a short Tee bar 2, a mounting support 3, a handle bar 4, a pull bar 5, a seat stay 6, a support bar 7, a front pedal mount 8, and a rear pedal mount 9.

The vertical section of the long Tee bar 1 includes two parallel bars 11, and the vertical section of the short Tee bar 2 is sandwiched between the two parallel bars 11 at a suitable position such that they form an arching firm support on the ground.

The mounting support 3 is a hollow support. Near its upper end is provided a pivot plate 31 at each lateral side for pivotal connection with an extreme end of the parallel bars 11. A lower end of the mounting support 3 is provided with the rear pedal mounting 9 which is substantially U-shaped with a pedal 91 movably disposed at either end thereof.

The handle bar 4 has a circular cross-section. It may be bent into any shape with a suitable bend (as shown in the figure). An upper end thereof is coupled with a pair of hand grips 41.

the pull rod 5 is movably provided between the mounting support 3 and the seat stay 6 by means of a positioning pin 10.

The seat stay 6 is a bar with a slightly bent tail portion. The tail portion is pivotally provided and positioned between the two parallel bars 11 of the long Tee bar 1. Two pivot plates 61 are disposed near the tail portion for pivotally positioning an extreme end of the pull bar 5 by means of a positioning pin 10. The seat stay 6 further has an extended section an upper end of which is provided for the positioning and support of a seat 62.

The support bar 7 is relatively short and its extreme end is penetrated by a positioning pin 10 to dispose between the parallel bars 11 at a middle section. A baffle post 11 is further disposed between the parallel bars 11 such that the baffle post 11 laterally urging the support bar 7 so that the support bar 7 may cooperate with the extended section of the seat stay 6 to provide an urging support. An upper end of the support bar 7 is provided with a resilient block 71 disposed between the support bar 7 and the seat stay 6 to achieve a upwardly baffling effect.

The pedal mounts 8 and 9 are respectively located at the extended section of the seat stay 6 and the extreme end of the support bar 7. Both are substantially U-shaped with a pedal 81, 91 movably disposed at either side thereof.

Figure 2:
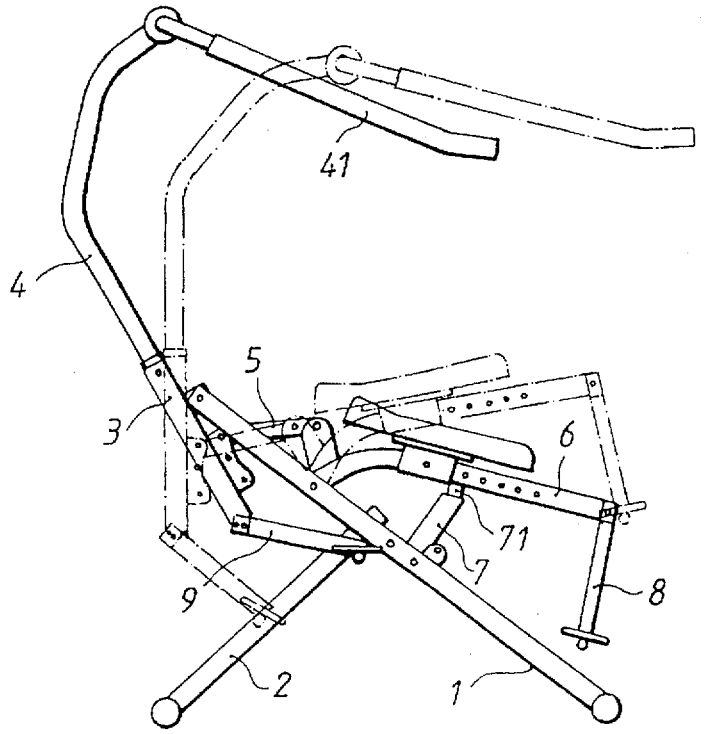
FIG. 2 is a schematic view illustrating the forward pushing action of the present invention.
Figure 3:
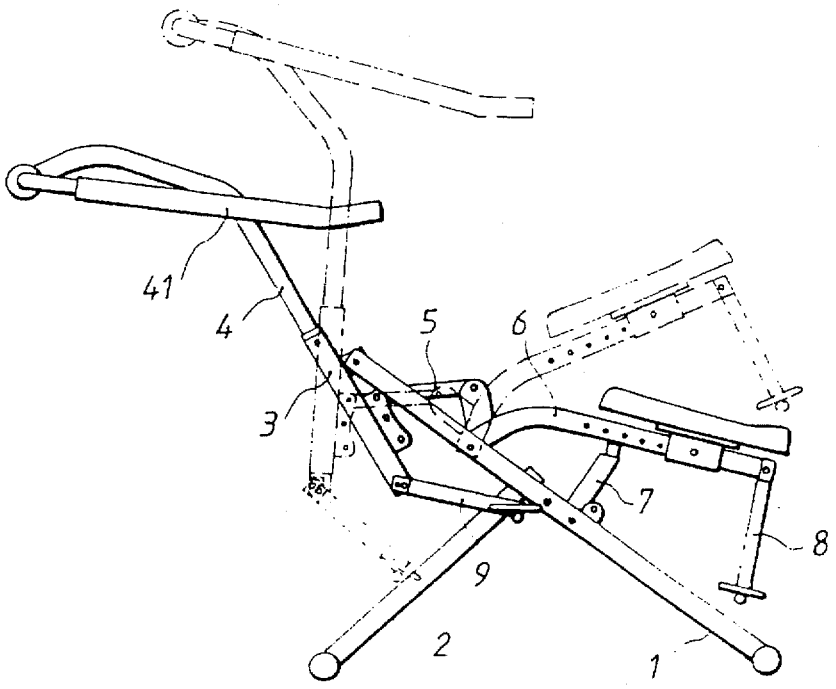
FIG. 3 is a schematic view illustrating the rearward pulling action of the present invention.

The components of the exercise apparatus has been described as above. In use, the user sits on the seat 62 facing the direction of the front pedal mount 8. Both hands turn behind to grip the hand grips 41 and exert a forward force (as shown in FIG. 2). The mounting support 3 along with the handle bar 4 are brought to move forwardly, and the pull bar 5 is pulled rearwardly so that the seat stay 6 elevates. When the force is relaxed, the exercise apparatus will resume its original position. Repeated exercise of pushing forwardly in the above manner provides good exercising effects due to the damping force thus generated. On the contrary, when the handle bar 4 is joined to the mounting support 3 in a reverse direction (as shown in FIG. 3), the user may sit with his/her face in the direction of the rear pedal mounting 9 and both hands holding the hand grips 41. The user then exerts a force to pull rearwardly so that the mounting support 3 along with the handle bar 4 is pulled rearwardly. With the pulling of the pull bar 5, the seat stay 6 is elevated. When the force is relaxed, the exercise apparatus will resume its original position. Repeated exercise of pulling rearwardly will provide good exercising effects.

Figure 4:
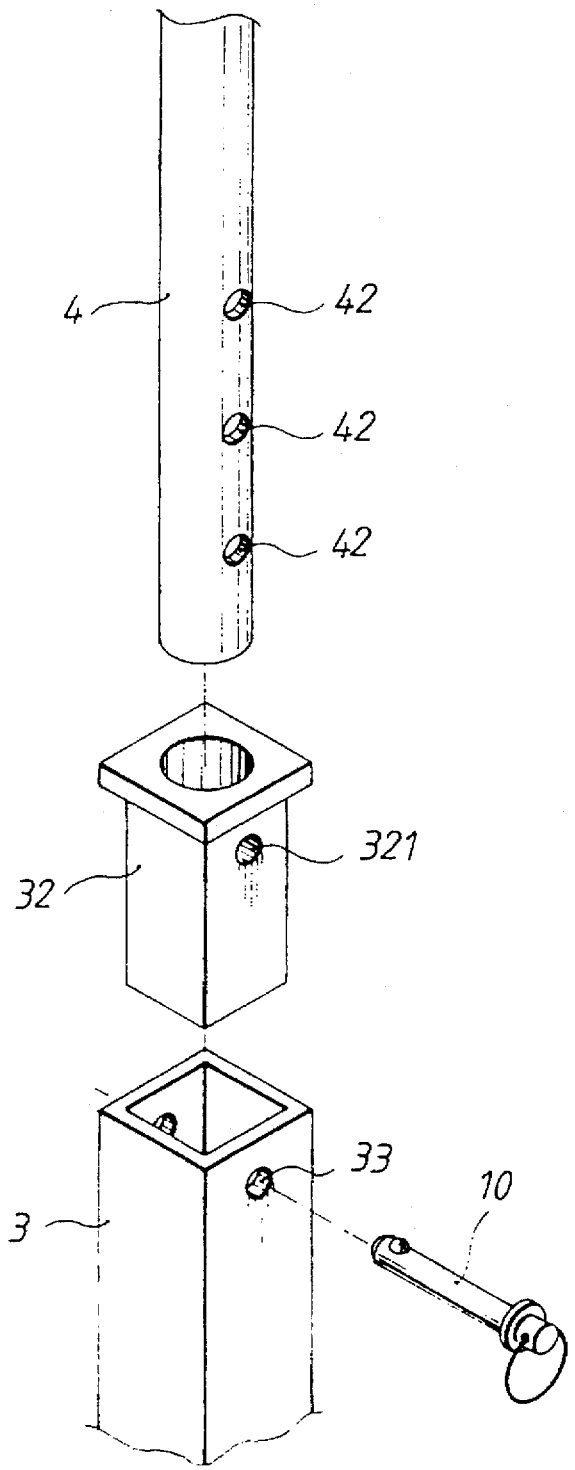
FIG. 4 is an elevational exploded view illustrating assembly of a mounting support to a handle bar via an inner bushing.

As shown in FIG. 4, the mounting support 3 includes an inner bushing 32 having a circular inner hole predisposed inside an interior thereof. Openings 33, 321 are respectively formed at the mounting support 3 and the bushing 32 at corresponding positions. A positioning pin 10 is inserted into the respective openings 33, 321 to position the bushing 32 in the mounting support 3. An insert end of the handle bar 4 is provided with a plurality of spaced holes 42. After the insert end of the handle bar 4 is fitted into the inner hole of the bushing 32, the length of the handle bar 4 may be adjusted by means of the spaced holes 42.

Figure 5:
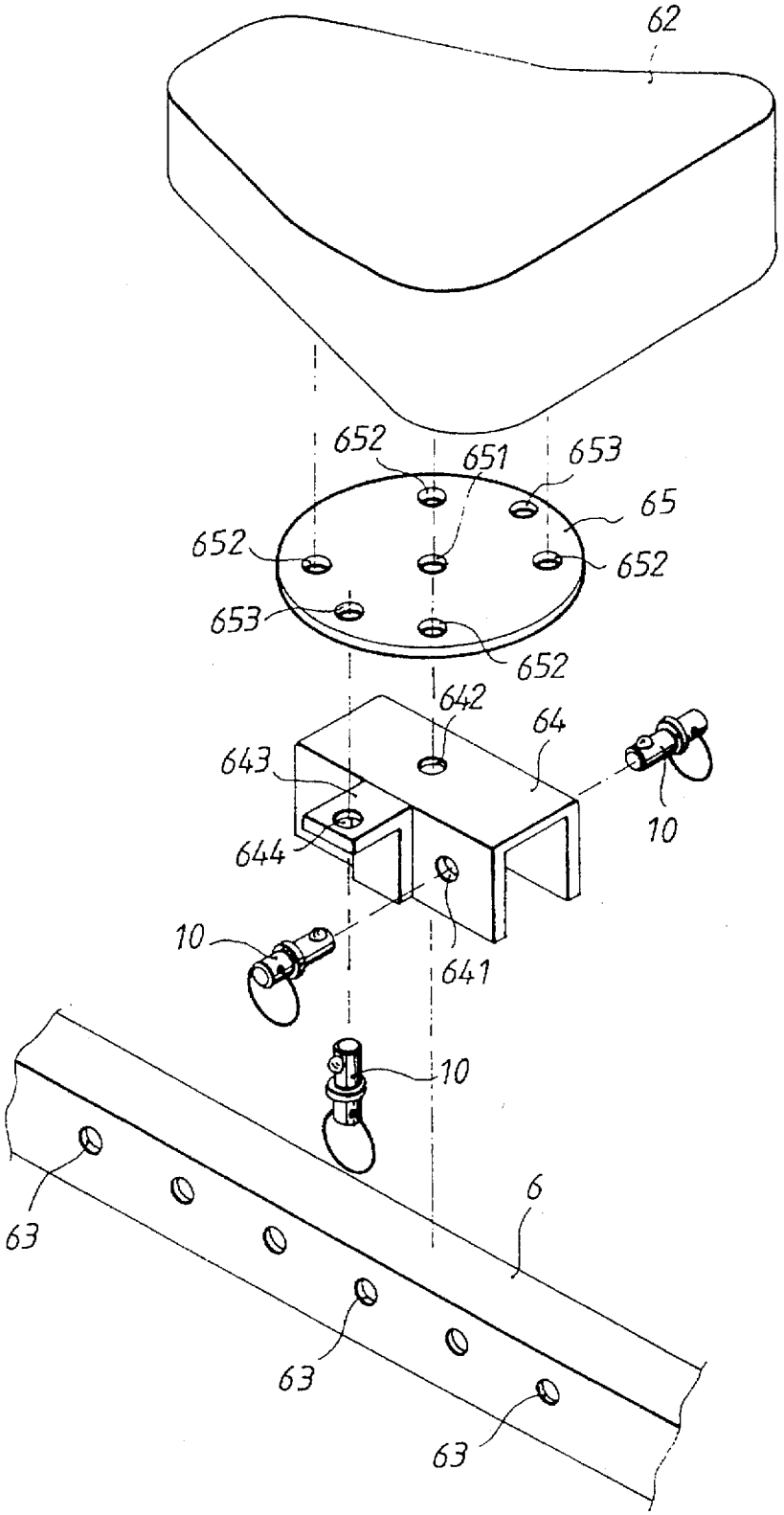
FIG. 5 is an elevational exploded view illustrating assembly of a seat stay to a seat via an adjustment seat.

With reference to FIG. 5, the extended section of the seat stay 6 is provided with a plurality of holes 63. An adjustment seat 64 of a substantially inverted-U shape is mounted on the seat stay 6 and is also provided with a plurality of holes 641 for matching the holes on the seat stay 6. The adjustment seat 64 may displace along the seat stay 6, and at least one positioning pin 10 may be used to pass through the corresponding holes 63 and 641 from one side or two sides to secure the adjustment seat 64 on the seat stay 6. The seat 62 has a locking plate 65 lockably provided at a lower end thereof. The locking plate 65 has a central hole 651, a plurality of radially spaced locking holes 652, and two 180 degrees spaced apart holes 653. The locking holes 652 are provided for locking with the seat 62, while the central hole 651 is movably connected to the central hole 642 of the adjustment seat 64 by means of a bolt (not shown). The adjustment seat 64 is further provided with a planar extension plate 643 with an insert hole 644 at one side thereof. The locking plate 65 may be secured to the extension plate 643 by means of a positioning pin 10 passing through either of the holes 653 and the insert hole 644 of the extension plate 643. As the selected hole 653 is located at 180 degrees from the other hole 653, the seat 62 may rotate about 180 degrees.

Figure 6:
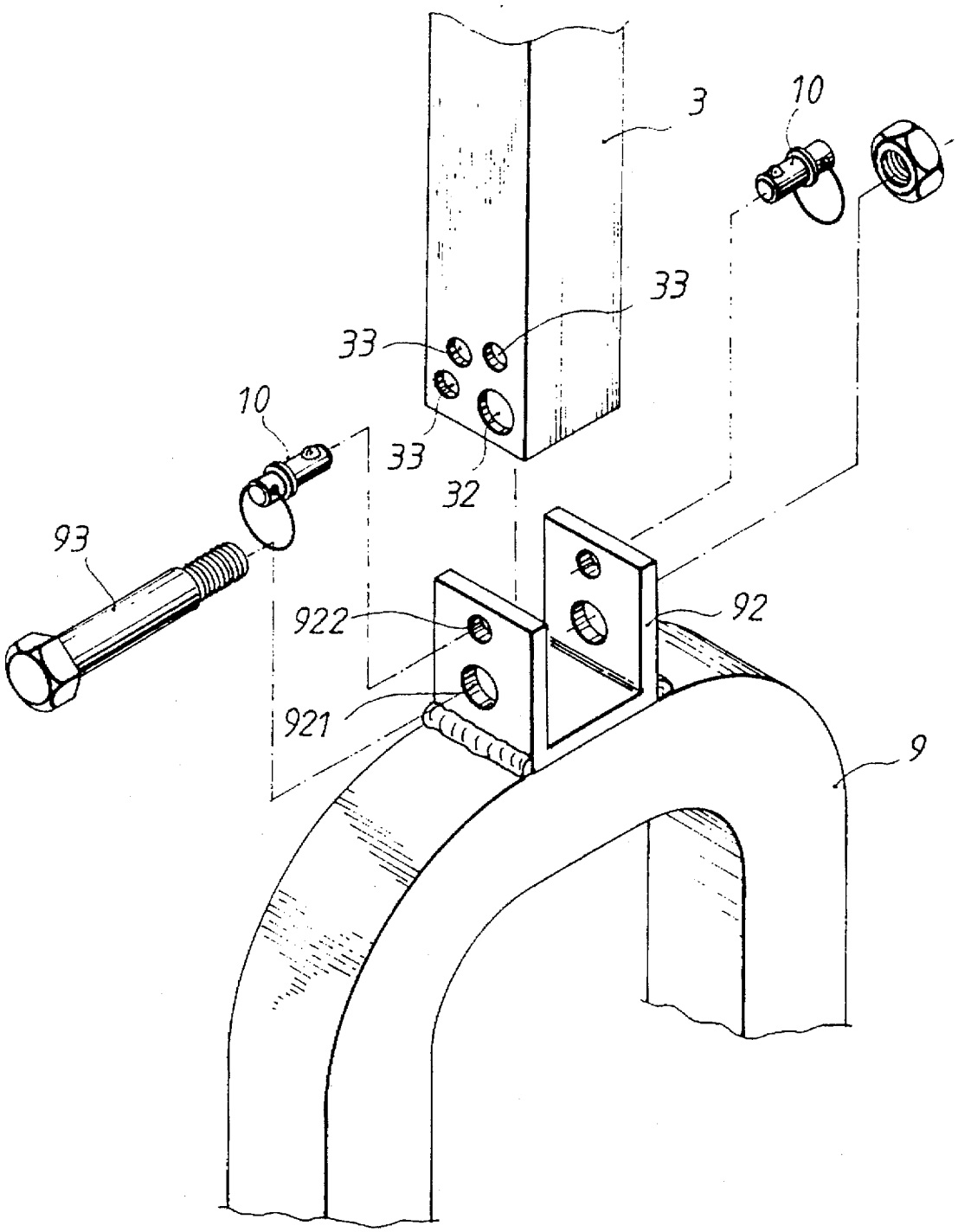
FIG. 6 is an elevational exploded view illustrating assembly of the mounting support and a rear pedal mount.

Referring to FIG. 6 which illustrates the connection of the mounting support 3 and the rear pedal mount 9. A locking hole 32 is formed at an end wall of the mounting support 3. Correspondingly, a locking piece 92 of a substantially inverted-U shape is provided at the rear pedal mount 9 at a suitable position. The locking piece 92 is further provided with a locking hole 921 and a lateral pivot hole 922. When the rear end of the mounting support 3 is disposed in the locking piece 92, the locking holes 32 and 921 are locked by means of a screw bolt 93. However, the mounting support 3 may be swung to one side slightly so as to select any pivot hole 33 to correspond to the pivot hole 922 of the rear pedal mount. At least one positioning pin 10 is used for securing purposes such that the mounting support 3 and the rear pedal mount 9 may be connected at various angles so that the user may modify the amount of force exerted.

Figure 7:
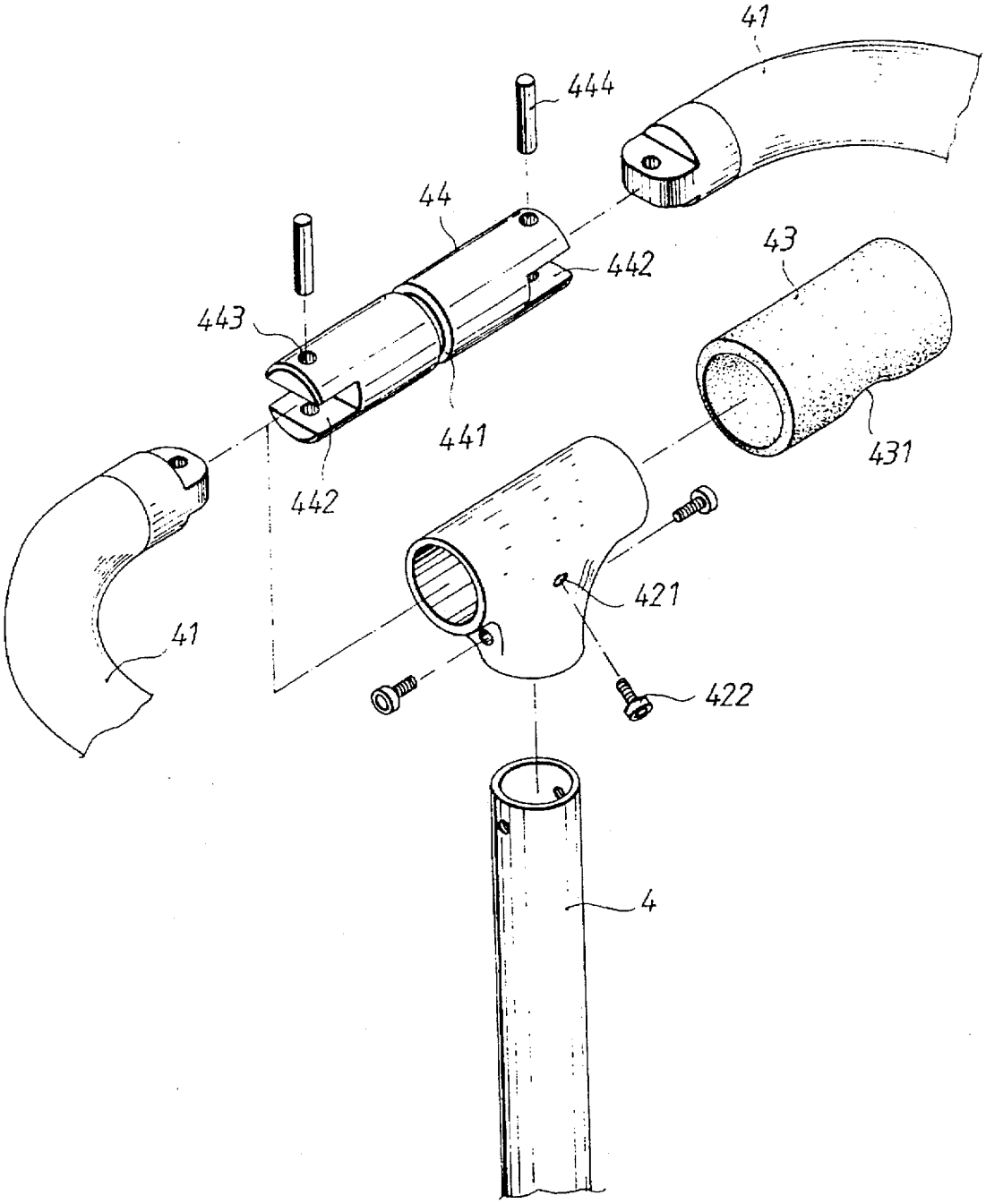
FIG. 7 is an elevational exploded view illustrating assembly of the handle bar and the hand grips.

FIG. 7 shows the connection of the handle bar 4 to the hand grips 41. A sleeve mount 42, a soft sleeve protector 43 and a movable shaft 44 are utilized for assembling the left and right hand grips 41. The sleeve mount 42 is a substantially T-shaped hollow tubular body with a vertical section inserting just into the handle bar 4. The sleeve protector 43 should however be fitted onto the sleeve mount 42 first. The sleeve mount 42 is further provided with an opening 421 in a middle portion thereof for locking of a small screw bolt 422 therein.

The sleeve protector 43 is made of suitably soft material and may fit onto the sleeve mount 42. Therefore, the sleeve protector 43 is also provided with an opening 431 for matching the opening 421.

The movable shaft 44 is fitted into the sleeve mount 42 and has a central annular groove 441. Both sides thereof are each provided with a slot mortise 442 and a pin hole 443. By means of positioning pins 44, the left and right hand grips 41 are fitted into the respective slot mortises 442 such that the left and right hand grips 41 may expand or oscillate to the outer side. The annular groove 441 are provided for receiving the small screw bolts 422 so that the movable shaft 44 may freely rotate and may be lockably secured in position.

Although the present invention has been illustrated and described with reference to the preferred embodiment thereof, it should be understood that it is in no way limited to the details of such embodiment but is capable of numerous modifications within the scope of the appended claims.

What is claimed is:

1. A push/pull exercising apparatus comprising:

a frame support comprising a long Tee bar and a short Tee bar, a vertical section of said long Tee bar being formed by two parallel rods, a vertical section of said short Tee bar being disposed in between said two parallel bars to form an arching fixed frame support on the ground;

a mounting support, said mounting support being a hollow bar and having an upper end pivotally connected to an extreme end of the vertical section of said long Tee bar;

a handle bar having a circular cross section that may be bent to have suitable angles if necessary, a pair of hand grips being disposed at an upper end of said handle bar;

a pull bar pivotally disposed between said mounting support and a seat stay by means of a positioning pin; said seat stay, said seat stay having a slightly bent tail portion, an end of said tail portion being pivotally positioned between said two parallel bars, an extreme end of said pull bar being pivotally positioned near said tail portion, said seat stay further having an extended section an upper side thereof supporting a seat;

a support bar, said support bar being a relatively short bar structure with an extreme end disposed at a middle portion of said parallel bars of said long Tee bar, a baffle post being provided between said parallel bars for laterally urging said support bar such that said support bar may work in cooperation with said extended section of said seat stay to constitute an urging support, an upper end of said support bar being provided with a resilient block disposed between said support bar and said seat stay to achieve an upwardly baffling effect;

said rear pedal mount and a front pedal mount both of which are substantially U-shaped having a pedal movably provided at either side thereof, said rear pedal mount being provided at a lower end of said handle bar, and said front pedal mount being provided at a front end of said extended section of said seat stay; whereby when the user sits on said seat and faces the direction of said front pedal mount with both hands gripping said hand grips behind and pushing forwardly, said mounting support and said handle bar will be driven forwardly such that said seat stay elevates to achieve a forwardly push exercising effect, and when the user sits on said seat and faces the direction of said rear pedal mount with both hands gripping said hand grips in front and pulling said hand grips rearwardly, said seat stay will also elevate to achieve a rearwardly pull exercising effect.

2. An exercising apparatus as claimed in claim 1, wherein said mounting support has an inner bushing having a circular inner hole pre-disposed into an interior of said support mounting, said mounting support and said bushing each having an opening formed at a corresponding position such that a positioning pin may pass through said openings for positioning purposes, and an insert end of said handle bar is provided with a plurality of spaced holes such that, after said handle bar is inserted into said bushing, the length of said handle bar may be adjusted of passing said positioning pin through a selected hole of said handle bar.

3. An exercising apparatus as claimed in claim 2, wherein said extended section of said seat stay is provided with a plurality of spaced holes, an inverted-U shaped adjustment seat having a plurality of corresponding holes being mounted on said extended section such that said adjustment seat may displace along said extended section and at least a positioning pin may be used to insert into a selected hole of said adjustment seat and said extended section from one or two sides for securing purposes; said seat having a locking plate lockably provided at a lower end thereof, said locking plate having a central hole, a plurality of locking holes, and two openings spaced 180 degrees apart, said locking holes being provided for locking with said seat stay, said central hole being movably coupled with a central hole of said adjustment seat by means of a bolt, said adjustment seat further having a planar extension plate having an insert hole disposed at one side thereof, a positioning pin being inserted through a selected opening of said locking plate and said insert hole to lock said adjustment seat and said locking plate together, said seat capable of 180 degrees rotation since said openings of said locking plate are spaced 180 degrees apart.

4. An exercising apparatus as claimed in claim 1, wherein said mounting support has an end wall provided with a locking hole and a plurality of pivot holes at one side of said locking hole; and said rear pedal mount is provided with a substantially inverted U-shaped locking piece having a locking hole and a lateral pivot hole, whereby when said end of said mounting support is disposed in said locking piece, a bolt may be passed through the corresponding locking holes to lock them together, and said mounting support may be swung slightly to one side before at least one positioning pin is used to pass through any one of said pivot holes and said pivot hole of said rear pedal mount to lock them together at a selected angle.

5. An exercising apparatus as claimed in claim 1, wherein said hand grips each comprises a sleeve seat and a soft sleeve protector, and a movable shaft is provided for mounting said hand grips to said handle bar, said sleeve seat being a substantially T-shaped hollow tubular structure having a vertical portion inserted and locked in said handle bar, said sleeve seat being fitted with said sleeve protection prior to the insertion, said sleeve seat having a screw hole in the middle for locking of a small bolt; said sleeve protector being formed of suitable soft material for fitting onto said sleeve seat and provided with an opening opposite to said vertical portion of said sleeve seat; and said movable shaft being inserted through said sleeve seat and having a central annular groove, said movable shaft having both sides each of which is provided with a slot mortise and a pin hole for securing the respective hand grips by means of positioning pins such that said hand grips may swing or stretch outwardly, said annular groove being provided for receiving said small bolt so that said movable shaft may freely rotate while being secured by the locking of said small bolt.

* * * * *